US007828608B2

(12) United States Patent
Aihara et al.

(10) Patent No.: US 7,828,608 B2
(45) Date of Patent: Nov. 9, 2010

(54) CONNECTOR HAVING TERMINAL HOLDING PORTION THAT CONTACTS A MATING TERMINAL

(75) Inventors: Tetsuya Aihara, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/510,458

(22) Filed: Jul. 28, 2009

(65) Prior Publication Data

US 2010/0029144 A1 Feb. 4, 2010

(30) Foreign Application Priority Data

Aug. 1, 2008 (JP) ..... 2008-199800

(51) Int. Cl.
*H01R 13/514* (2006.01)

(52) U.S. Cl. ..... 439/752; 439/733.1

(58) Field of Classification Search ..... 439/733.1, 439/751, 752, 752.5, 682, 884, 869
See application file for complete search history.

(56) References Cited

U.S. PATENT DOCUMENTS 5,489,221 A 2/1996 Fujiura et al.
6,155,885 A 12/2000 Kumakura
6,520,811 B2 * 2/2003 Mitani et al. ..... 439/852
6,866,523 B2 * 3/2005 Yamashita ..... 439/79
7,037,146 B2 * 5/2006 Nakamura ..... 439/751
7,708,605 B2 * 5/2010 Shibata et al. ..... 439/733.1
2009/0239414 A1 * 9/2009 Hiramatsu ..... 439/572

FOREIGN PATENT DOCUMENTS

JP 55-57987 4/1980

* cited by examiner

*Primary Examiner*—Hae Moon Hyeon
(74) *Attorney, Agent, or Firm*—Gerald E. Hespos; Michael J. Porco

(57) ABSTRACT

A connector (10) has a terminal fitting (17) press-fit into a terminal holding portion (18). The terminal fitting (17) has a wide rectangular cross-sectional shape and includes a lower surface (17A), two side surfaces (17B) standing upward from the opposite lateral edges of the lower surface (17A) and an upper surface (17C) connecting the upper edges of the side surfaces (17B). The terminal holding portion (18) includes two side walls (18B) that interfere with the side surfaces (17B), a bottom wall (18A) formed with lower interfering portions (18E) that interfere with non-touching parts (17D) of the lower surface portion (17A) not to be held in contact with a mating terminal fitting (21) and a ceiling wall (18C) formed with upper interfering portions (18D) that interfere with non-touching parts (17D) of the upper surface (17C) not to be held in contact with the mating terminal fitting (21).

14 Claims, 6 Drawing Sheets

CONNECTOR HAVING TERMINAL HOLDING PORTION THAT CONTACTS A MATING TERMINAL

BACKGROUND OF THE INVENTION

1. Field of the Invention

The invention relates to a connector in which a terminal fitting is press-fitted into a terminal holding portion.

2. Description of the Related Art

U.S. Pat. No. 6,155,885 and Japanese Unexamined Utility Model Publication No. S55-57987 disclose connectors with a terminal fitting that is press-fit into a terminal holding portion. Each of these connectors has a terminal holding portion that interferes with four corners of a terminal fitting that has a wide rectangular cross-sectional shape. The terminal fitting is held at four corners so that a touching part to be connected with a contact portion of a mating terminal fitting does not interfere with the terminal holding portion. Thus, the touching part will not be damaged and resin will not adhere to the touching part so that connection reliability is improved. However, this terminal holding portion holds only the four corners of the terminal fitting. As a result, a sufficient terminal holding force cannot be obtained and the terminal fitting cannot be positioned accurately. U.S. Pat. No. 5,489,221 discloses a terminal fitting that interferes with a terminal holding portion over the entire periphery. Thus, the touching part interferes with the terminal holding portion to reduce connection reliability as described above.

Improved connection reliability for the press-fit terminal fitting, improved positioning accuracy for the press-fit terminal fitting and a sufficient terminal holding force for the press-fit terminal fitting are contradictory and it has been very difficult to fulfill these problems simultaneously.

The invention was developed in view of the above and an object is to improve connection reliability of a terminal fitting, increase a terminal holding force and/or improve the positioning accuracy of the terminal fitting.

SUMMARY OF THE INVENTION

The invention relates to a connector with at least one terminal fit press-fit into a terminal holding portion and held therein. The terminal fitting has a wide rectangular cross-sectional shape and includes a base surface, two side surfaces projecting from the base surface and a ceiling surface connecting the side surfaces and arranged to face the base surface. The terminal holding portion includes two side walls that interfere with the side surfaces, a base wall with at least one lower interfering portion that interferes with at least one non-touching part of the base surface not to be held in contact with a mating terminal fitting and a ceiling wall with at least one second interfering portion that interferes with at least one non-touching part of the ceiling surface not to be held in contact with the mating terminal fitting.

The terminal fitting is press-fit into the terminal holding portion and is held strongly held while being positioned by the interference of the side surfaces with the side walls, the non-touching part of the ceiling surface with the upper interfering portion and the non-touching part of the base surface with the lower interfering portion. On the other hand, the touching parts of the ceiling and base surfaces that contact the mating terminal fitting are free from damage and resin adhesion so that connection reliability is improved. Therefore, it is possible to improve the connection reliability of the terminal fitting, increase a terminal holding force and improve positioning accuracy.

The non-touching parts of the ceiling surface and the base surface may be provided respectively in a pair at the opposite sides of corresponding touching parts to be held in contact with the mating terminal fitting.

Both the upper interfering portion and the lower interfering portion) may be so provided in a pair as to substantially correspond to the corresponding pair of non-touching parts.

According to this construction, the non-touching parts of the ceiling surface can interfere with the upper interfering portions and the non-touching parts of the base surface can interfere with the lower interfering portions.

Each side wall and the upper and lower interfering portions arranged at the opposite upper and lower sides of the side wall may be provided integrally or unitarily to form a substantially U-shape. According to such a construction, the side wall, the upper interfering portion and the lower interfering portion can be provided unitarily and strengthened more than in the case where they are provided separately.

The terminal fitting may be press-fit into the terminal holding portion from behind the back wall. Thus, the terminal fitting can be held by being press-fit into the terminal holding portion from behind the back wall.

The base surface, the side surfaces and/or the ceiling surface may be tapered toward a leading end.

Touching parts of the ceiling and/or base surfaces that can contact with the respective contact portions of the mating terminal fitting may not interfere with the base wall and/or the ceiling wall.

Loose movements of the terminal fitting in forward and backward directions may be restricted in use by a terminal holding force resulting from frictional resistance with the side walls and the first and second interfering portions.

The non-touching parts of the ceiling surface and the base surface may be provided respectively in a pair at the opposite sides of corresponding touching parts to be held in contact with the mating terminal fitting.

Both the first and second interfering portions may be provided in a pair to correspond to the corresponding pair of non-touching parts.

Each side wall and the first and second interfering portions arranged at the opposite upper and lower sides of the side wall may be provided integrally or unitarily to form a substantially U-shape.

The connector may comprise a housing formed with a forwardly open receptacle and having the terminal holding portion formed in a back wall of the receptacle.

The terminal fitting may be press-fitted into the terminal holding portion from behind the back wall.

The base surface, the pair of side surfaces and the ceiling surface may be tapered toward a leading end.

Touching parts of the ceiling and/or base surfaces that can contact the respective contact portions of the mating terminal fitting do not interfere with the base wall and/or the ceiling wall.

The invention also improves connection reliability of a terminal fitting, increase a terminal holding force for the terminal fitting and improve the positioning accuracy of the terminal fitting.

These and other features and advantages of the invention will become more apparent upon reading the following detailed description and accompanying drawings. Even though embodiments are separately described, single features thereof may be combined to additional embodiments.

DETAILED DESCRIPTION OF THE PREFERRED EMBODIMENTS

Figure 1:
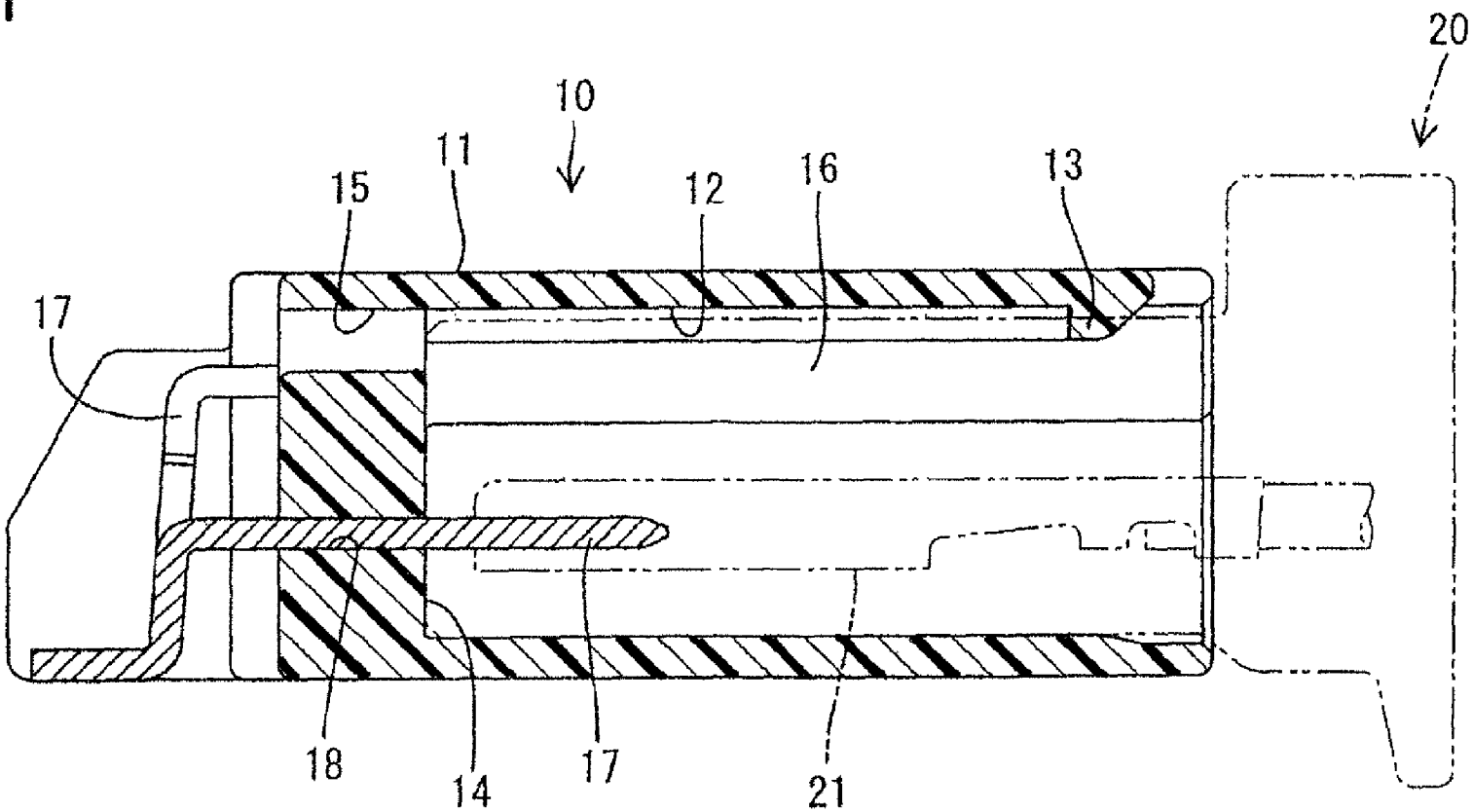
FIG. 1 is a section showing a connected state of a connector according to a first embodiment and a mating connector.

A connector in accordance with a first embodiment of the invention is identified by the numeral 10 in FIGS. 1 to 5. The connector 10 is a circuit board connector and is placed at a specified position on a printed-wiring board (not shown) and fixed preferably by soldering. The connector 10 is connectable with a mating connector 20. In the following description, connecting directions of the connector 10 and the mating connector 20 are referred to as forward and backward directions and connection surface sides thereof as front ends.

The connector 10 includes a housing 11 made e.g. of synthetic resin. The housing 11 includes a receptacle 12 having an open front end. A lock 13 projects down from the front end of the ceiling surface of the receptacle 12. A mold removal hole 15 left upon forming the lock 13 is formed in a back wall 14 of the receptacle 12 behind the lock 13.

Figure 2:
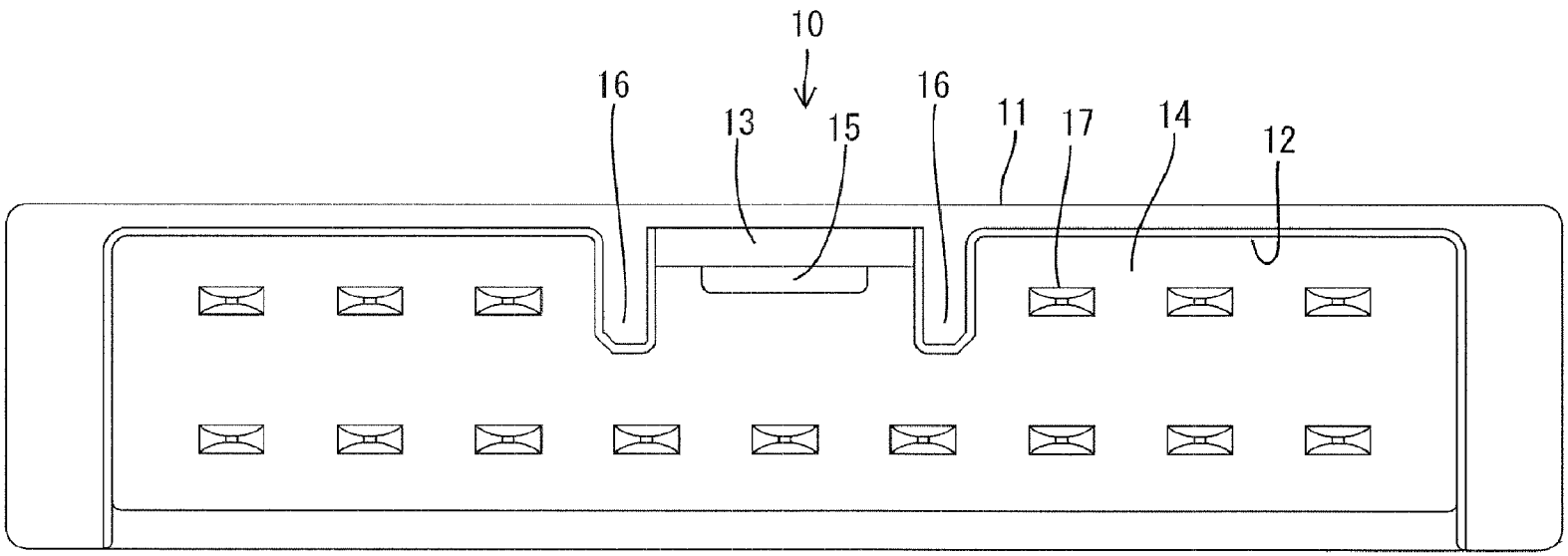
FIG. 2 is a front view of the connector of the first embodiment.

The housing 11 has a wide flat shape as shown in FIG. 2. Two guide ribs 16 are provided at opposite left and right sides of the lock 13 in the housing 11 and extend in substantially forward and backward directions. The guide ribs 16 are engageable with guide recesses (not shown) formed in the mating connector 20 to guide a connecting operation of the connectors 10, 20.

L-shaped fixing brackets are to be mounted at the opposite left and right surfaces of the housing 11. The fixing brackets are formed by press-working a metal plate and fixed by being pressed into the housing 11. The fixing brackets include soldering portions arranged along the top surface of a circuit board. Thus, the connector 10 can be fixed onto the circuit board by soldering the soldering portions to the circuit board.

The mating connector 20 can fit into the receptacle 12 and is formed with a lock hole (not shown) for receiving the lock projection 13 when the mating connector 20 is connected with the connector 10. Thus, the engagement of the lock projection 13 with the inner surfaces of the lock hole in forward and backward directions hold the connectors 10, 20 in the properly connected state.

Figure 3:
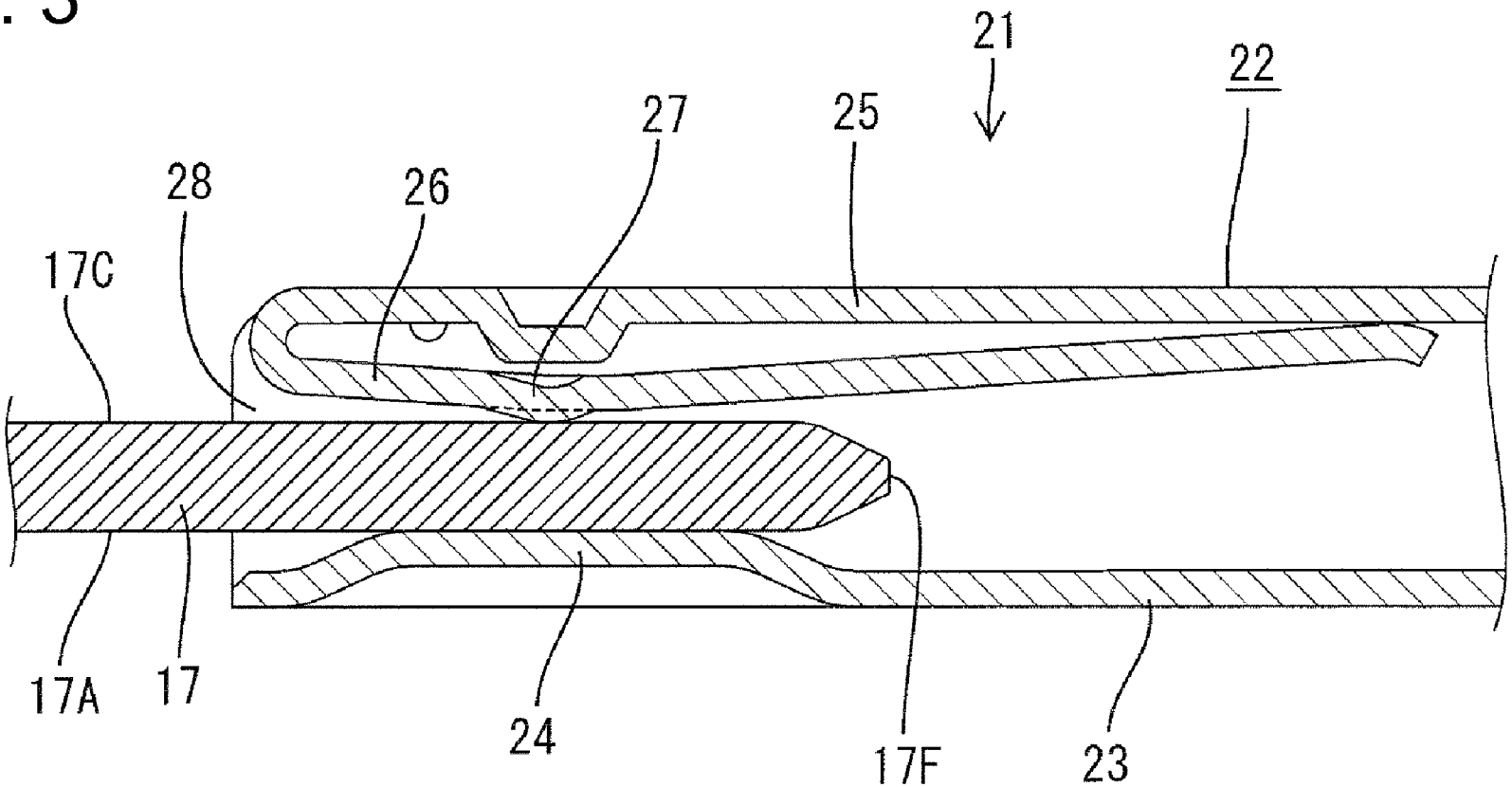
FIG. 3 is a section showing a connected state of a terminal fitting of the first embodiment and a mating terminal fitting.

Tab-shaped terminal fittings 17 are arranged in upper and lower levels to project forward from the back wall 14 of the receptacle 12, as shown in FIGS. 1 and 2. As shown in FIG. 1, the terminal fittings 17 are connectable respectively with mating terminal fittings 21 in the mating connector 20. As shown in FIG. 3, each mating terminal fitting 21 has a main portion 22 in the form of a substantially rectangular tube, and a front opening 28 for guiding the terminal fitting 17 to the inside is formed at the front of the main portion 22.

A lower wall 23 of the main portion 22 is hammered to project inward of the main portion 22, thereby forming a lower contact 24 slightly recessed inwardly from the lower wall 23. The main portion 22 also has an upper wall 25 opposed to the lower wall 23 and a resilient contact piece 26 is folded back from a front end of the upper wall 25. The resilient contact piece 26 is resiliently displaceable in a substantially vertical direction. Additionally, the resilient contact piece 26 is hammered or embossed to form a round upper contact 27 that projects down at a position opposed to the lower contact 24.

The thickness of the terminal fitting 17A exceeds a distance between the upper contact 27 of the resilient contact piece 26 in a natural state and the lower contact 24. Accordingly, the resilient contact piece 26 resiliently deforms when the terminal fitting 17 is inserted through the front opening 28 of the main portion 22 between the upper and lower contacts 27 and 24. Thus, the upper and lower contacts 27, 24 resiliently contact the terminal fitting 17 to electrically connect both terminal fittings 17, 21.

Figure 4:
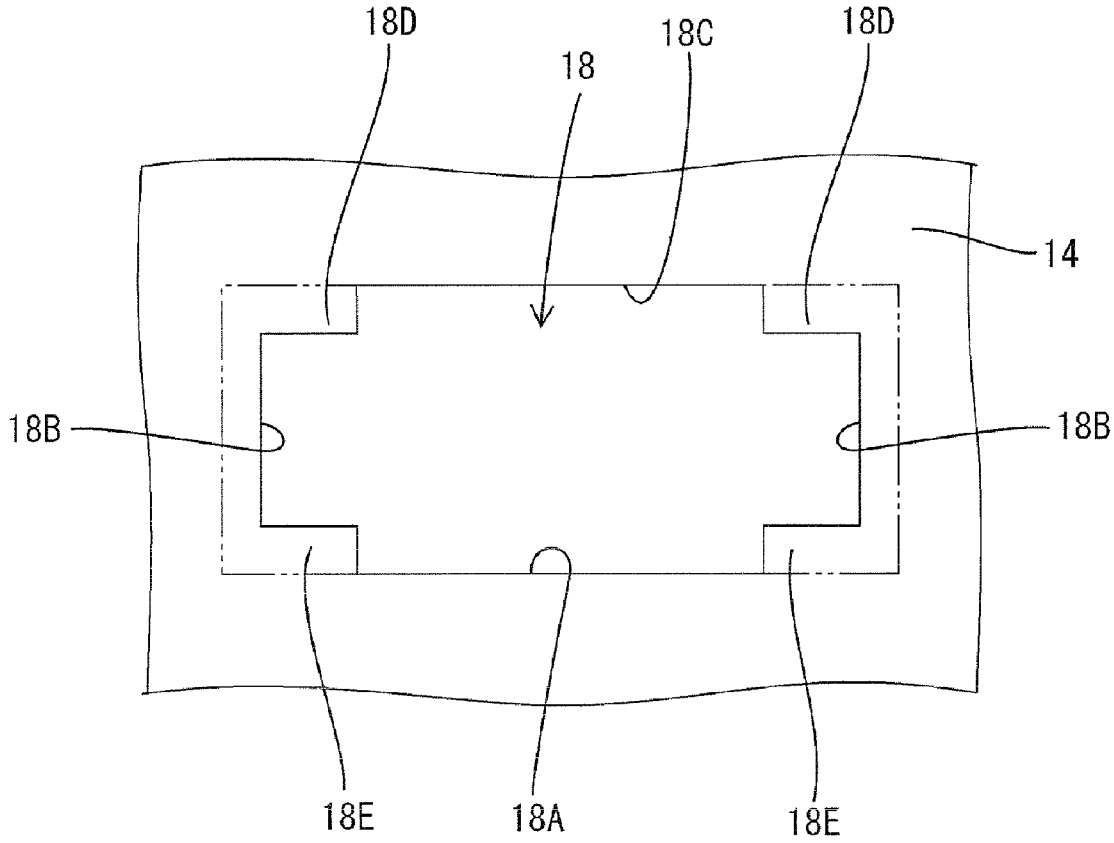
FIG. 4 is a front view of a terminal holding portion before the terminal fitting is press-fitted in the first embodiment.

As shown in FIG. 4, terminal holding portions 18 penetrate the back wall 14 of the receptacle 12 in forward and backward directions and hold the terminal fittings 17 that have been press fit therein. Each terminal holding portion 18 includes a bottom wall 18A forming a lower side, two side walls 18B forming left and right sides and a ceiling wall 18C forming an upper side. Wide rectangular lower interfering portions 18E are provided on the opposite left and/or right sides of the bottom wall 18A and extend in substantially forward and backward directions. Similarly, wide rectangular upper interfering portions 18D are provided on the opposite left and right sides of the ceiling wall 18C and extend in substantially forward and backward directions.

The side walls 18B and the upper and lower interfering portions 18D, 18E are unitary with opposite upper and lower ends of the side walls 18B to form a substantially U-shape. Thus, the side walls 18B and the upper and lower interfering portions 18D, 18E will not deform when subjected to stress during insertion of the terminal fitting 17, and terminal fitting 17 bites reliably into the side walls 18B and the upper and lower interfering portions 18D, 18E.

Figure 5:
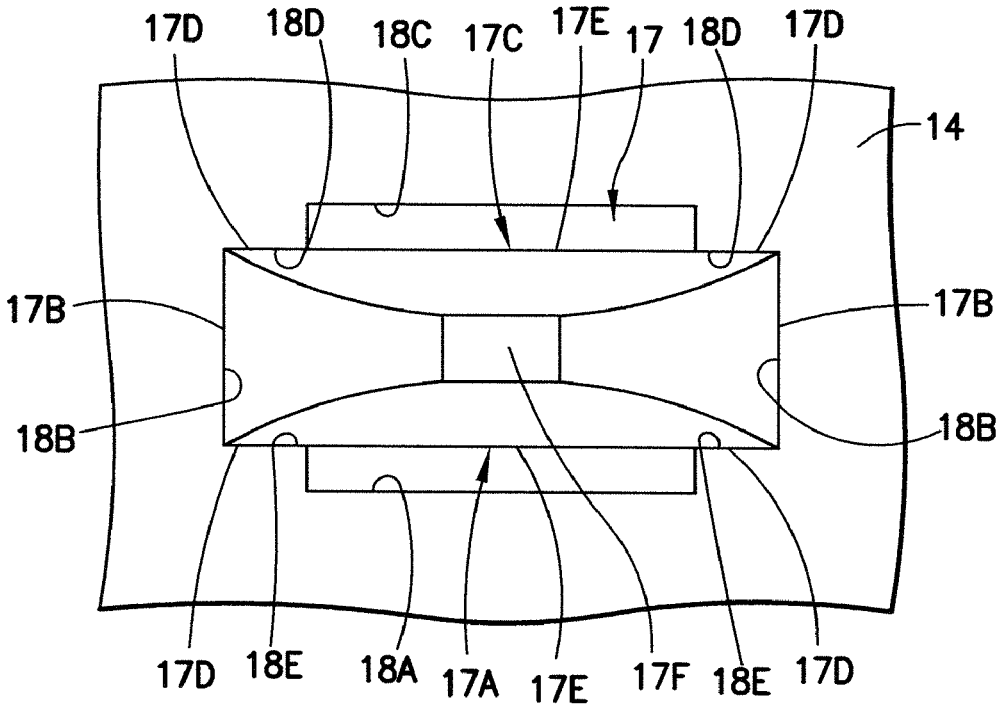
FIG. 5 is a front view of the terminal holding portion after the terminal fitting is press-fitted in the first embodiment.

As shown in FIG. 5, the terminal fitting 17 has a wide rectangular cross-sectional shape with a lower surface 17A, side surfaces 17B projecting substantially normally up from opposite lateral edges of the lower surface 17A and an upper surface 17C opposite the lower surface 17A and connecting upper edges of the side surfaces 17B. The lower surface 17A, the side surfaces 17B and the upper surface 17C are tapered toward a leading end 17F.

The terminal fitting 17 is press-fit and held in the terminal holding portion 18. As a result, the side surfaces 17B interfere with the side walls 18B, non-touching parts 17D of the upper surface 17C that do not contact the upper contact 27 interfere with the upper interfering portions 18D and the non-touching parts 17D of the lower surface 17A that do not contact the lower contact 24 interfere with the lower interfering portions 18E.

The upper and lower interfering portions 18D, 18E restrict loose vertical movements of the terminal fitting 17 and the side walls 18B restrict loose lateral movements of the terminal fitting 17. As a result, the terminal fitting 17 is positioned and held with respect to vertical and lateral directions. Further, loose movements of the terminal fitting 17 in forward and backward directions are restricted by a strong terminal holding force resulting from frictional resistance with the side walls 18B and the upper and lower interfering portions 18D, 18E so that the terminal fitting 17 cannot to come out of the terminal holding portion 18.

Touching parts 17E of the upper and lower surfaces 17C, 17A that contact the upper and lower contacts 27, 24 do not interfere with the bottom wall 18A and the ceiling wall 18C. As a result, the touching parts 17E avoid damage and resin adhesion to improve connection reliability of the terminal fitting 17 and the mating terminal fitting 21.

The housing 11 and the terminal fittings 17 are set at specified positions in a press fitting machine (not shown). Subsequently, the terminal fittings 17 are press-fit accurately into the terminal holding portions 18 at specified press-in positions by having specified parts pushed by the press fitting machine. At this time, the side surfaces 17B interfere with the side walls 18B, the non-touching parts 17D of the lower surface 17A interfere with the lower interfering portions 18E and the non-touching parts 17D of the upper surface 17C interfere with the upper interfering portions 18D. However, the touching parts 17E of the upper surface 17C and the touching parts 17E of the lower surface 17A do not interfere with the ceiling wall 18C and the bottom wall 18A.

Accordingly, there is little likelihood of damage or resin adhesion to the touching parts 17E so that connection reliability of terminal fittings 17 and the mating terminal fittings 21 is improved. Further, loose vertical and lateral movements of the terminal fittings 17 are restricted and loose movements of the terminal fittings 17 in forward and backward directions are restricted by frictional resistance with the terminal holding portions 18. Accordingly, it is possible to improve the connection reliability of the terminal fittings 17 and the mating terminal fittings 21, increase the terminal holding forces for the terminal fittings 17 and improve the positioning accuracy of the terminal fittings 17.

Figure 7:
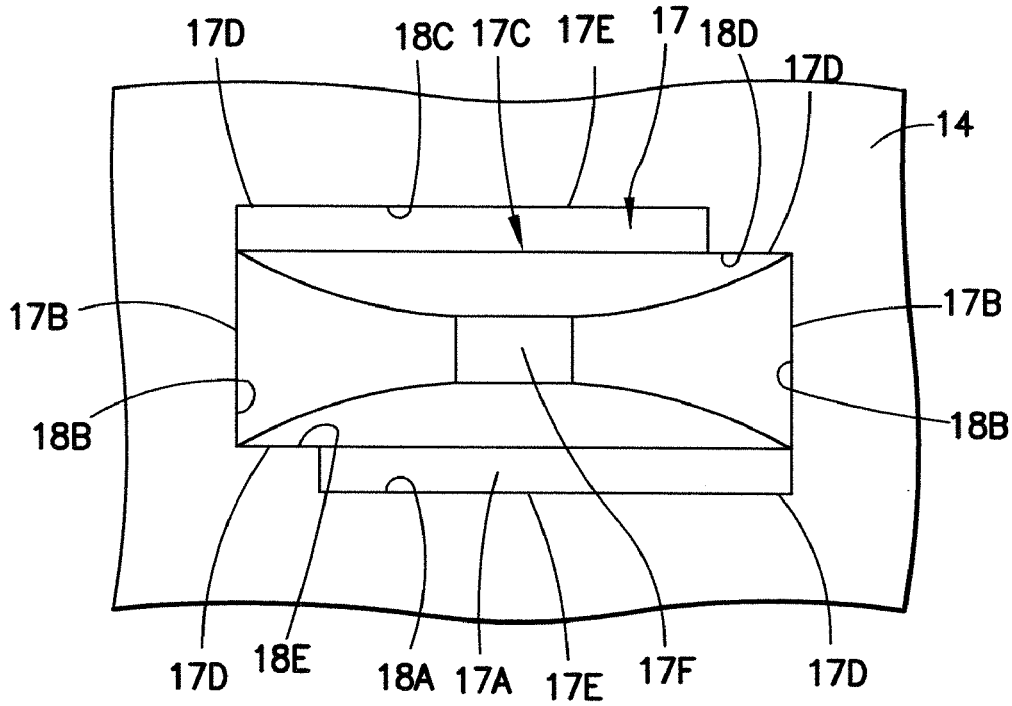
FIG. 7 is a front view of the terminal holding portion after the terminal fitting is press-fitted in the second embodiment.
Figure 6:
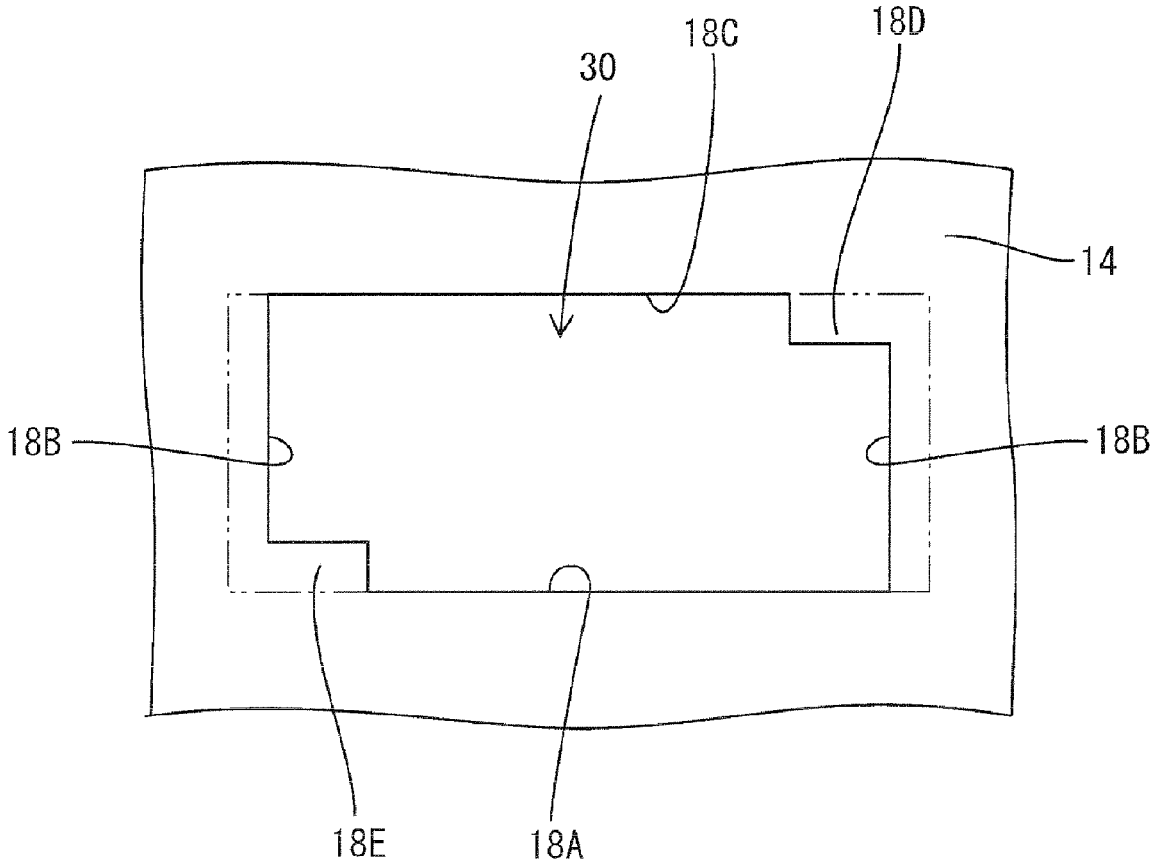
FIG. 6 is a front view of a terminal holding portion before a terminal fitting is press-fitted in a second embodiment.

A second embodiment of the invention is described with reference to FIGS. 6 and 7. Elements of the second embodiment that are the same as or similar to the first embodiment are identified by the same reference numeral, but are not described again. A terminal holding portion 30 of the second embodiment omits one of the upper interfering portions 18D of the first embodiment and one of the lower interfering portions 18E as shown in FIG. 6. The upper interfering portion 18D and the lower interfering portion 18E are arranged at diagonal positions of the terminal holding portion 30 and are in substantially a point symmetric manner with respect to a longitudinal axis of the terminal fitting 17. Thus a terminal fitting 17 can be held from upper and lower sides in a well-balanced manner by the upper and lower interfering portions 18D, 18E while touching parts 17E wider than in the first embodiment are ensured.

The invention is not limited to the above described and illustrated embodiments. For example, the following embodiments are also included in the technical scope of the present invention.

Although the upper and lower interfering portions 18D, 18E are arranged at the diagonal positions of the terminal holding portion 18 in the second embodiment, both of them may be arranged at the left or right side according to the invention. Further, either one of the upper and lower interfering portions 18D, 18E may be arranged at the opposite left and right sides.

Although the upper interfering portion 18D and the lower interfering portion 18E are unitary to the side wall 18B in the above embodiments, the side wall 18B, the upper interfering portion 18D and the lower interfering portion 18E may be provided separately according to the invention.

Although the invention is applied to a circuit board connector in the above embodiments, it may be applied to an intermediate connector including intermediate terminals. In this case, terminal holding portions may be formed to penetrate a partition plate partitioning one end and the other end of the intermediate terminals and the intermediate terminals may be press-fit into this terminal holding portions.

What is claimed is:

1. A connector comprising a terminal holding portion and at least one terminal fitting press-fit therein, wherein:

the terminal fitting having a wide substantially rectangular cross-sectional shape and includes a base surface, two side surfaces projecting from the base surface and a ceiling surface connecting the side surface portions and opposite the base surface, and the terminal holding portion includes two side walls that interfere with the side surfaces, a base wall formed with at least one first interfering portion that interferes with at least one non-touching part of the base surface not to be held in contact with a mating terminal fitting and a ceiling wall formed with at least one second interfering portion that interferes with at least one non-touching part of the ceiling surface not to be held in contact with the mating terminal fitting.

2. The connector of claim 1, wherein the non-touching parts of the ceiling surface and the base surface are provided respectively in a pair at the opposite sides of corresponding touching parts to be held in contact with the mating terminal fitting.

3. The connector of claim 2, wherein both the first and second interfering portions are provided in a pair corresponding to the corresponding pair of non-touching parts.

4. The connector of claim 1, wherein each side wall and the first and second interfering portions arranged at the opposite upper and lower sides of the side wall are provided unitarily to form a substantially U-shape.

5. The connector of claim 1, further comprising a housing formed with a receptacle having an open front end and a back wall, the terminal holding portion being formed in the back wall.

6. The connector of claim 5, wherein the terminal fitting is press-fit into the terminal holding portion from behind the back wall.

7. The connector of claim 1, wherein the base surface, the side surfaces and the ceiling surface are tapered toward a leading end.

8. The connector of claim 1, wherein touching parts of the ceiling and base surfaces that can contact the respective contact portions of the mating terminal fitting do not interfere with the base wall and the ceiling wall.

9. The connector of claim 1, wherein loose movements of the terminal fitting in forward and backward directions are restricted in use by a terminal holding force resulting from frictional resistance with the side walls and the first and second interfering portions.

10. A connector comprising:

at least one terminal fitting having a wide substantially rectangular cross-sectional shape with a base surface, a ceiling surface opposite the base surface and two opposite side surfaces, the base surface and the ceiling surface each having at least one non-touching part adjacent at least one of the side surfaces and a touching part spaced inwardly from the side surfaces; and a housing with a back wall and at least one terminal holding aperture extending through the back wall for receiving the terminal fitting, the terminal holding portion including two side opposed side surfaces that engage the side surfaces of the terminal fitting, a base surface in opposed non-interfering relationship to the touching part of the base surface of the terminal fitting, a ceiling surface in opposed non-interfering relationship to the touching part of the ceiling surface of the terminal fitting, at least one first interfering portion projecting from the base surface and at least one of the side surfaces of the terminal holding aperture and engaging the non-touching part of the base surface of the terminal fitting and at least one second interfering portion projecting from the ceiling surface and at least one of the side surfaces of the terminal holding portion (18) and engaging the non-touching part of the ceiling surface of the terminal fitting.

11. The connector of claim 10, wherein the base surface and the ceiling surface of the terminal fitting each have two spaced apart non-touching parts, the base surface of the terminal holding aperture has two spaced apart first interfering portions engaged respectively with the two spaced apart non-touching parts on the base surface of the terminal fitting and the ceiling surface of the terminal holding aperture has two spaced apart second interfering portions engaged respectively with the two spaced apart non-touching parts on the ceiling surface of the terminal fitting.

12. The connector of claim 11, wherein the interfering portions are in press-fit engagement with the non-touching parts of the terminal fitting.

13. The connector of claim 12, wherein the side surfaces of the terminal holding aperture are in press-fit engagement with the side surfaces of the terminal fitting.

14. The connector of claim 10, wherein the base surface, the side surfaces and the ceiling surface of the terminal fitting are tapered toward a leading end.

* * * * *